United States Patent [19]

Greenwood

[11] 3,935,435

[45] Jan. 27, 1976

[54] GASOLINE DISPENSER

[75] Inventor: Robert C. Greenwood, Cypress, Calif.

[73] Assignee: Pan-Nova, Inc., Santa Fe Springs, Calif.

[22] Filed: Oct. 21, 1974

[21] Appl. No.: 516,289

Related U.S. Application Data

[62] Division of Ser. No. 427,579, Dec. 26, 1973, Pat. No. 3,871,503.

[52] U.S. Cl. ..... 235/151.34; 194/13; 222/23; 222/36

[51] Int. Cl.[2] ..... G07F 13/02

[58] Field of Search ..... 235/151.34; 222/23, 30, 222/36, 37, 71, 2, 26; 194/13

[56] References Cited

UNITED STATES PATENTS

| | | | |
|---|---|---|---|
| 3,731,777 | 5/1973 | Burke et al. | 194/13 |
| 3,737,017 | 6/1973 | Brunone | 194/13 |
| 3,747,732 | 7/1973 | Mitchell | 194/13 X |
| 3,751,642 | 8/1973 | Todd et al. | 235/151.34 |
| 3,768,617 | 10/1973 | Young | 194/13 |
| 3,813,527 | 5/1974 | Langston | 235/151.34 |
| 3,845,848 | 11/1974 | Robbins | 194/13 |

*Primary Examiner*—Edward J. Wise
*Attorney, Agent, or Firm*—Harris, Kern, Wallen & Tinsley

[57] ABSTRACT

An automatic gasoline dispenser receiving tokens from customers and paying out change to the nearest penny for gasoline purchased but not dispensed. A dispenser with an accuracy of one four hundredth of a gallon and indicating volume dispensed to one four hundredth of a gallon. An automatic dispenser delivery gasoline to the last full cent when the total amount purchased is taken by the customer.

4 Claims, 11 Drawing Figures

DISPLAY SEGMENT IDENTIFICATION bp = BACKPLANE

LOGIC SYMBOLS

GASOLINE DISPENSER

This is a division of application Ser. No. 427,579, filed Dec. 26, 1973, now U.S. Pat. No. 3,871,503.

BACKGROUND OF THE INVENTION

This invention relates to automatic fluid dispensing systems such as are used in the gasoline pumping installations and at automobile stations. However, it will be readily recognized that the system of the invention can be utilized for dispensing other fluids in other environments.

A typical gasoline dispenser includes a remotely positioned fluid pump, one or two flow control valves, a hose with nozzle for insertion into the vehicle tank with a flow control on the nozzle, and one or more manually operated switches for starting and stopping the system. Fluid flow through the outlet line is measured, the volume of material dispensed is calculated and displayed, the price or monetary amount of the sale of material is calculated and displayed, and the unit price of the material is displayed.

The present invention is directed to automatic fluid dispensers wherein the customer makes an initial deposit, with the dispenser providing payout of change of the customer in the event that the customer does not take all of the fuel initially paid for. The customer may make a deposit by inserting tokens or coins or bills into the dispenser, or by dealing with an attendant who will introduce the deposit data into the system by electrical or mechanical means.

A variety of automatic gasoline dispensers with change making capability are described in the prior art and a number of them have been placed in service. Typical systems are disclosed in the following U.S. Patent Nos. and the art of record therein: 3,550,743; 3,605,973; 3,666,928 and 3,731,777. The first two patents describe improved electromechanical systems and the latter two patents disclose more advanced solid-state systems. The present invention is a digital solid-state electronic dispensing system that is an improvement on the prior art systems providing increased accuracy, performance and reliability.

SUMMARY OF THE INVENTION

The dispensing system of the invention may use a conventional pump, flow meter, valves and nozzle for handling the fluid dispensed, and conventional coin or token receiving and paying mechanisms, with new and improved computing and control. One important feature of the invention is the provision of separate isolated compartments for the gasoline flow path and for the electronics, with fiber optic lines running between the electronics and the flow meter and nozzle motion detector, eliminating switches and electrical lines in the gasoline handling compartment. Another feature is the increased accuracy of measurement and display, with one embodiment providing for delivery of gasoline to $1/400^{th}$ of a gallon and display indication to $1/400^{th}$ of a gallon. A further feature is a computation and logic system which provides a display of price/gallon, number of gallons dispensed, amount of money or tokens deposited, dollar amount of gasoline delivered, and dollar amount of change due the customer. A further feature is a logic circuit which assures the customer of receiving the correct amount of gasoline to the last half cent.

These and other objects, advantages, features and results will more fully appear in the course of the following description where a preferred embodiment of the present invention is given by way of illustration or example.

DESCRIPTION OF THE PREFERRED EMBODIMENT

Figure 1:
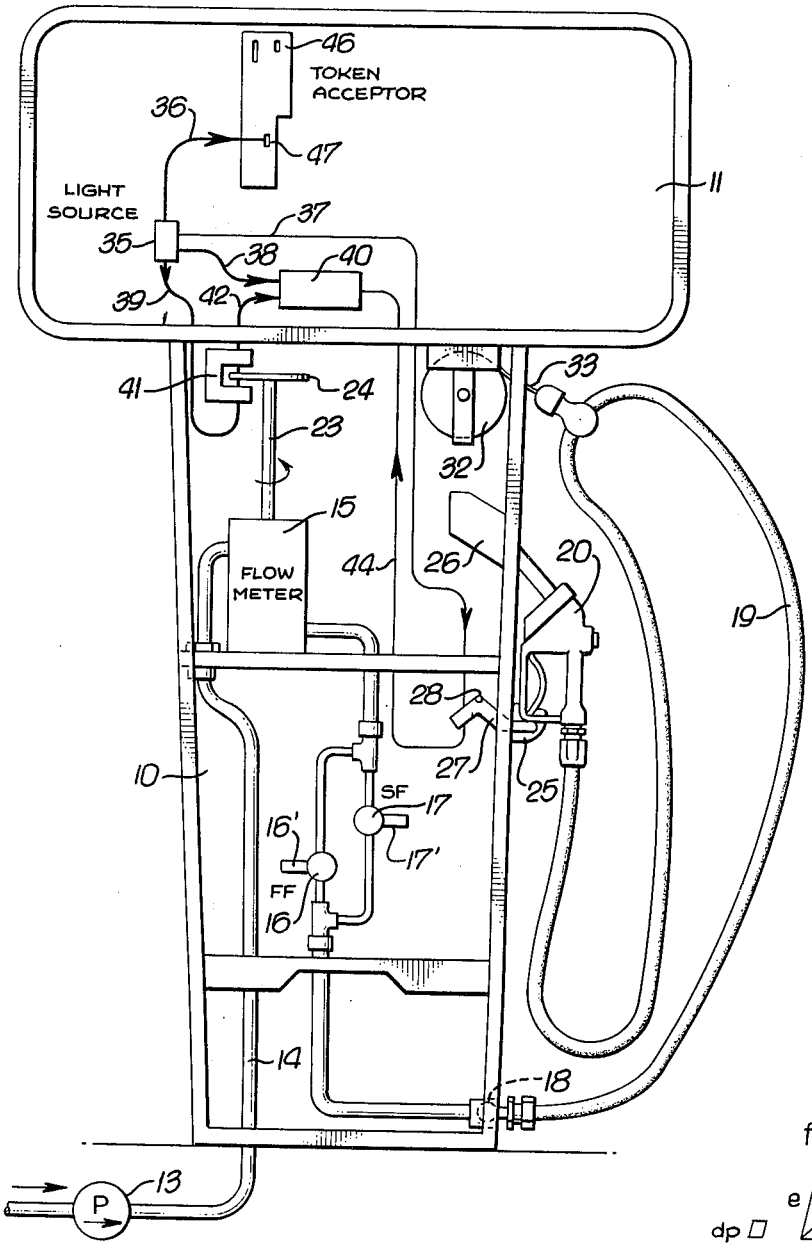
FIG. 1 is a front view of a gasoline dispenser with cover panels removed and incorporating the presently preferred embodiment of the invention.

In the operation of the dispenser illustrated in the drawings, the customer removes the nozzle from the nozzle receptacle and places it in the fuel tank and then deposits one or more dollar tokens in the slot of the token acceptor. The word token is used herein but the system is equally applicable with coins or paper money or other items. In an alternative configuration, the deposit may be made by pushing a button or actuating a switch or by remote control, it only being necessary that an electrical signal representing the monetary amount be introduced into the system. The customer then pushes the start button and gasoline is dispensed into the vehicle tank. When all of the gasoline purchased has been delivered, the system shuts off automatically, after which the customer replaces the nozzle and drives away. If the vehicle tank is filled before all of the gasoline paid for is dispensed, the automatic shutoff on the nozzle will stop fluid flow. The customer can then replace the nozzle in the nozzle receptacle and change to the exact penny will be delivered to the customer. If for any reason, the customer wants to terminate gasoline dispensing before receiving all that he has paid for, he can push the stop button and replace the nozzle in the receptacle, after which change will be dispensed to the exact penny for the amount of fuel purchased but not delivered. The operation of the system as described above is the same as some of the prior art systems, but the internal construction and operation of the present system differs from the prior art systems.

The dispenser illustrated in FIG. 1 has a lower compartment 10 for piping, valves and the like, and an upper compartment 11 for token handling mechanisms and electronics. In the view of FIG. 1, the side panels are removed, with the internal components shown diagrammatically. The upper compartment 11 is isolated from the lower compartment 10 by the bottom plate of the upper compartment.

A motor driven pump 13 provides gasoline through line 14, fluid flow meter 15, fast flow valve 16 and slow flow valve 17, swivel coupling 18 and hose 19 to a nozzle 20. The valves 16, 17 are operated by solenoids 16', 17', respectively. The flow meter 15 may be a conventional fluid flow meter having an output shaft 23 which rotates as a function of fluid flow through the meter. A clear plastic disk 24 having 100 equally spaced black or opaque segments thereon is mounted on the shaft 23. When not in use, the nozzle 20 rests on a bracket 25 with the end in a receptacle 26. A crank arm 27 pivoted at 28 is rotated clockwise to the position shown in FIG. 1 when the nozzle is returned to the receptacle. A reel 32 with cable 33 may be mounted in the compartment 10 for supporting the hose 19.

Signals are transmitted from the compartment 10 to the compartment 11 by an optical system. A light source 35 provides light on fiber optic lines 36, 37, 38 and 39. The line 38 goes directly to a light sensor unit 40 which provides an electrical output signal indicating whether or not the light source 35 is operating. Line 39 goes to a bracket 41 in the lower compartment 10, with another line 42 leading from the bracket 41 to the sensor unit 40. The bracket 41 and disk 24 are positioned so that the opaque segments of the disk interrupt the light path from the light source 35 to the sensor unit 40 as the flow meter shaft 23 rotates. In the particular embodiment disclosed herein, 400 segments pass the light guide per gallon of fluid flow through the flow meter, providing an electrical output of 400 pulses per gallon. The light source, fiber optic lines, and light sensors may be standard components.

Fiber optic line 37 runs into the lower compartment 10 to a bracket (not shown) adjacent the crank arm 27, with another fiber optic line 44 running from the bracket to the sensor unit 40. When the nozzle is in the receptacle as shown in FIG. 1, the light path through lines 37, 44 is blocked. When the nozzle is removed from the receptacle, light may pass from the source through lines 37 and 44 to the sensor unit. A token acceptor 46 is mounted in the upper compartment 11 and has its own light sensor 47. Line 36 terminates adjacent the sensor 47 so that the light path from the source 35 to the sensor 47 is interrupted each time a valid token is accepted by the token acceptor 46. The isolation between the compartments 10, 11, with the optical signal coupling from compartment 10 to compartment 11 enables the electrical system to be removed from the hazardous area within the compartment 10 and eliminates the need for explosion proof containers for the metering system.

Figure 4:
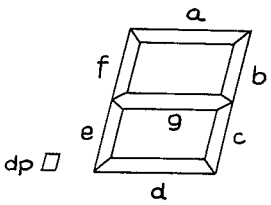
FIG. 4 illustrates the seven segment numerals of the displays of FIG. 2.
Figure 2:
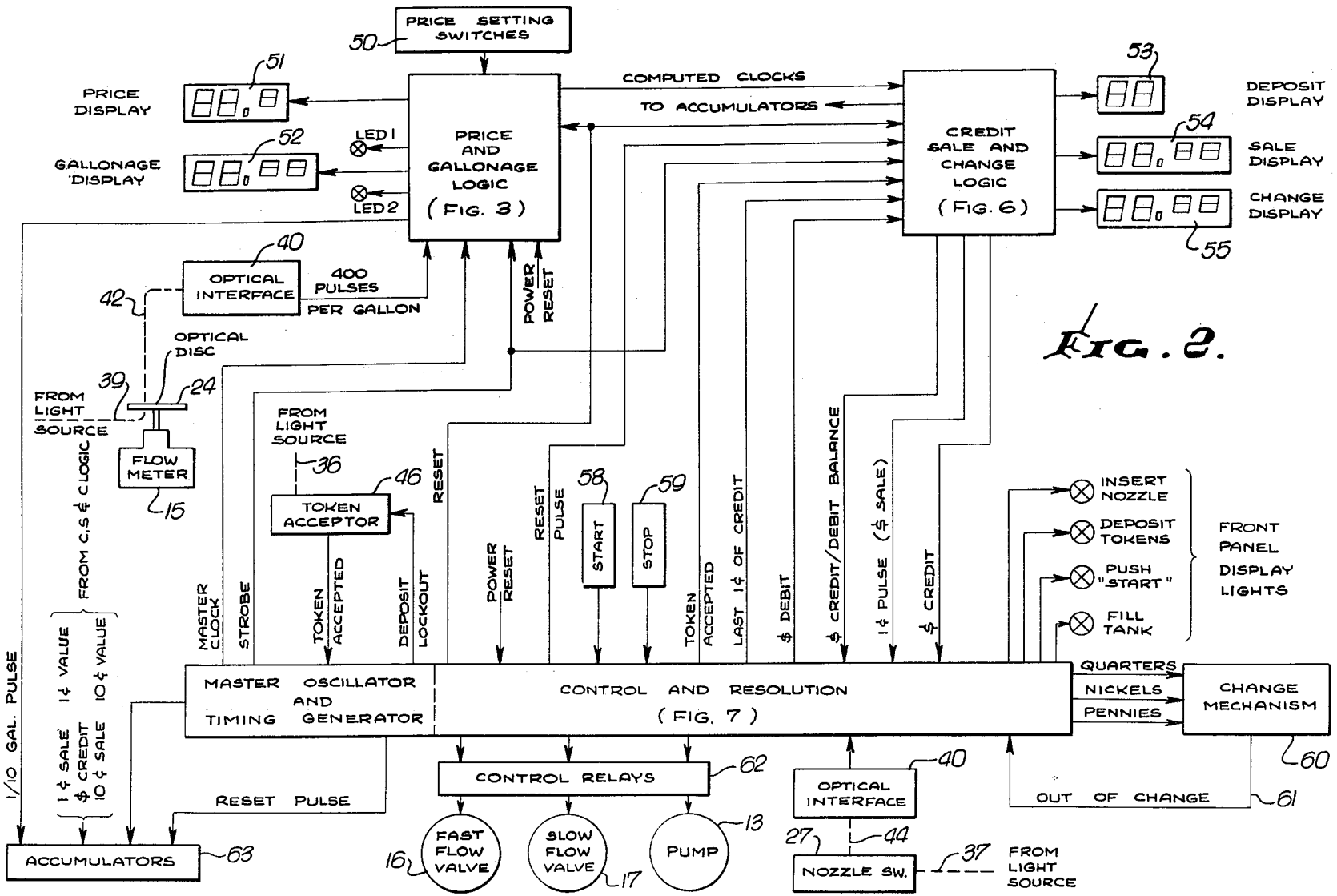
FIG. 2 is a block-diagram of the gasoline dispenser of FIG. 1.
Figure 3A:
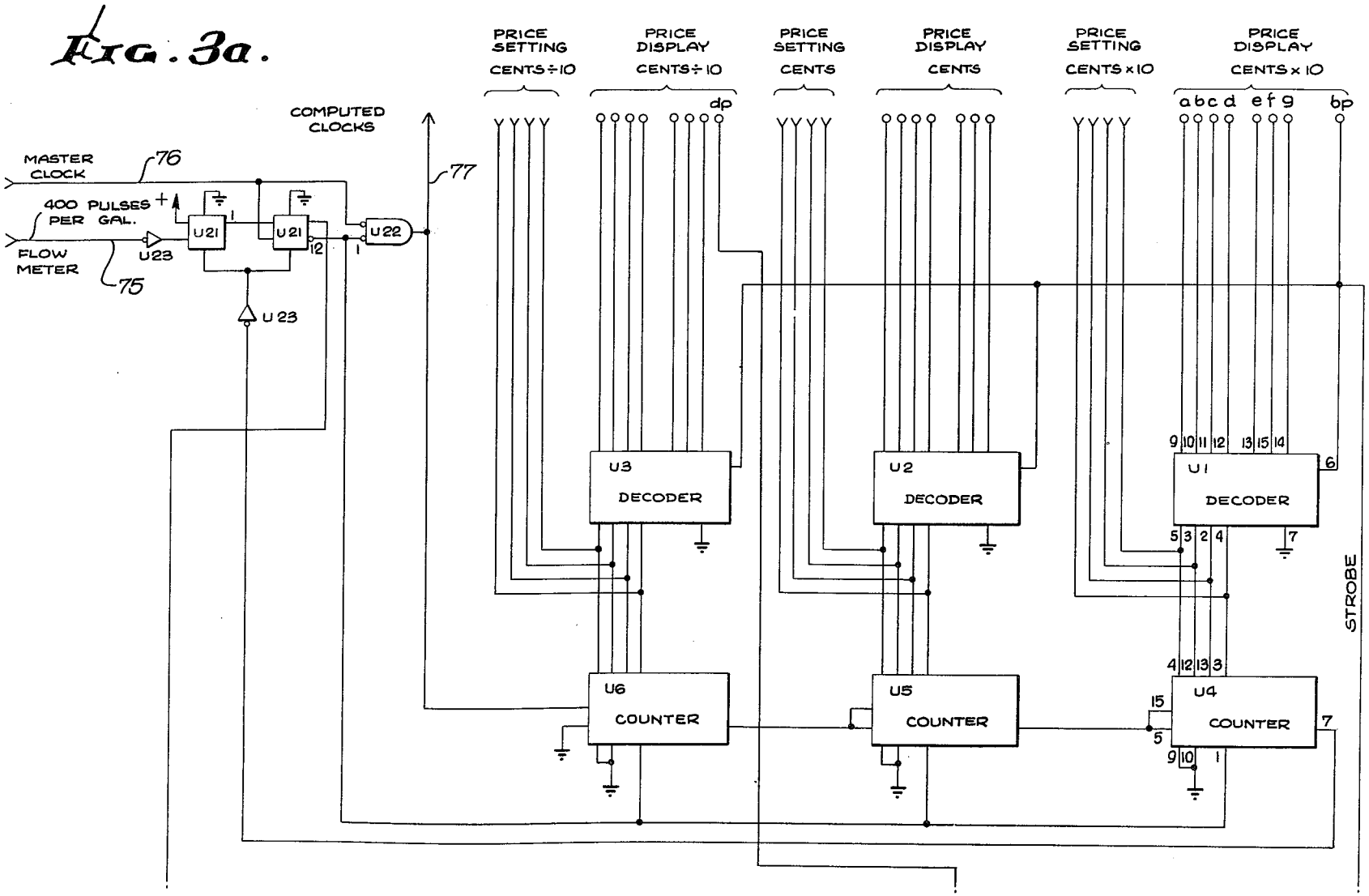
FIGS. 3*a* and 3*b* are an electrical diagram of the price and gallonage logic of FIG. 2.
Figure 3B:
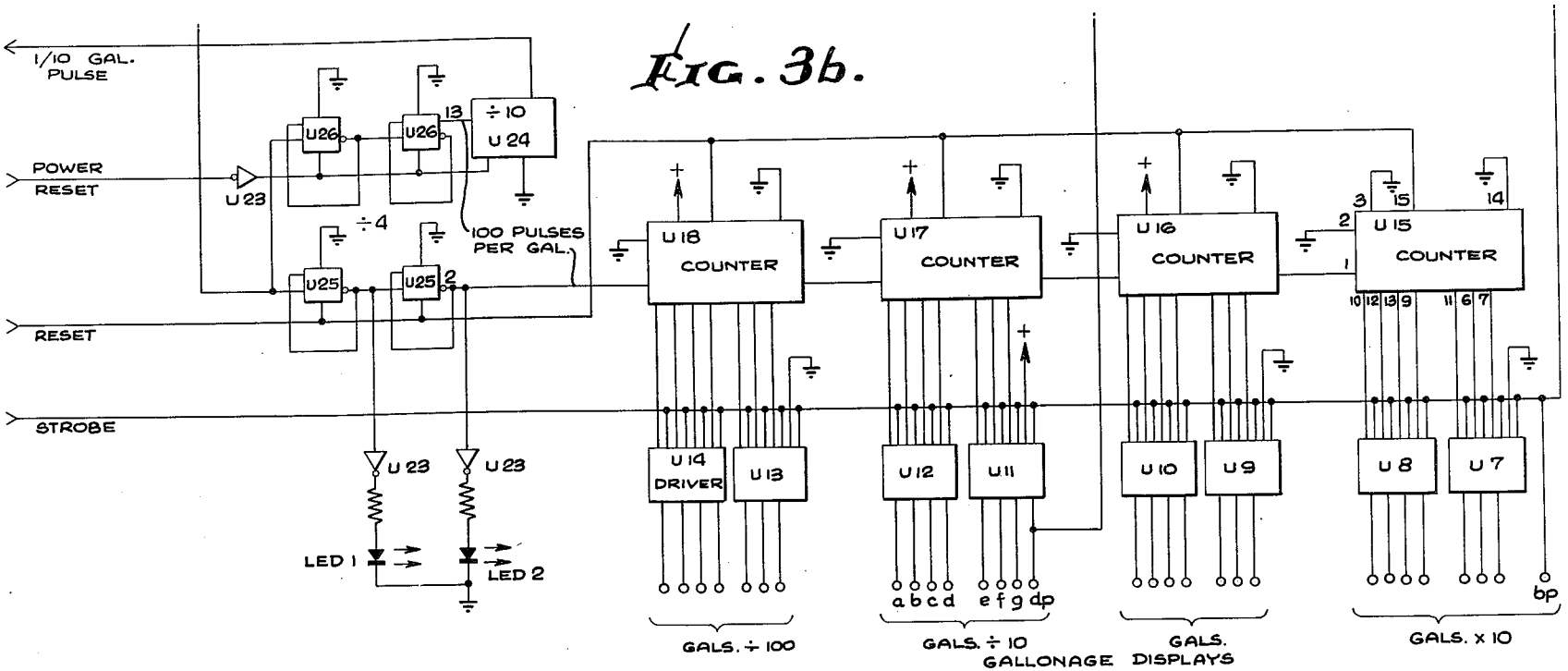
Figure 6A:
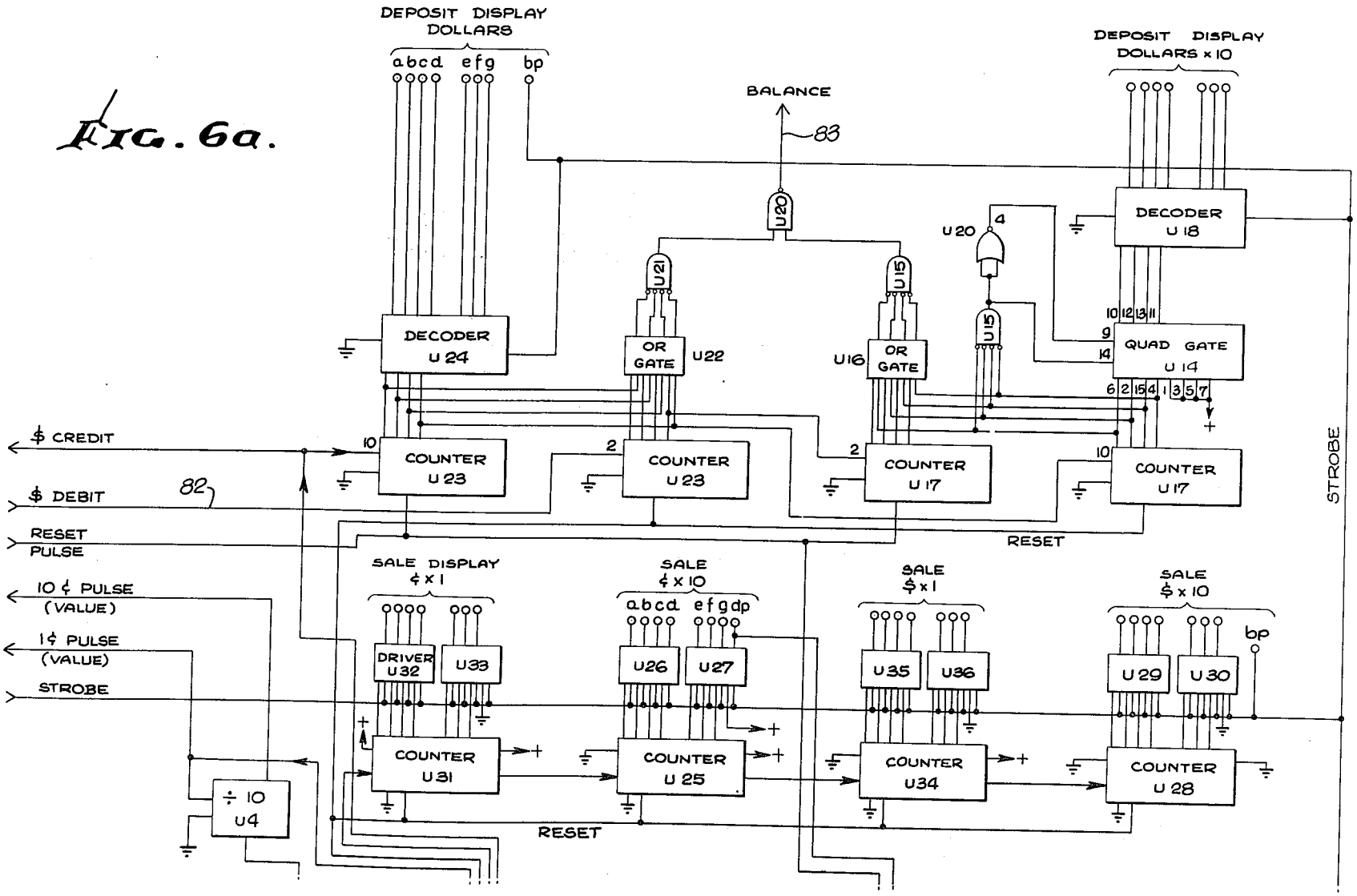
FIGS. 6*a* and 6*b* are a diagram of the credit, sale and change logic of FIG. 2.
Figure 6B:
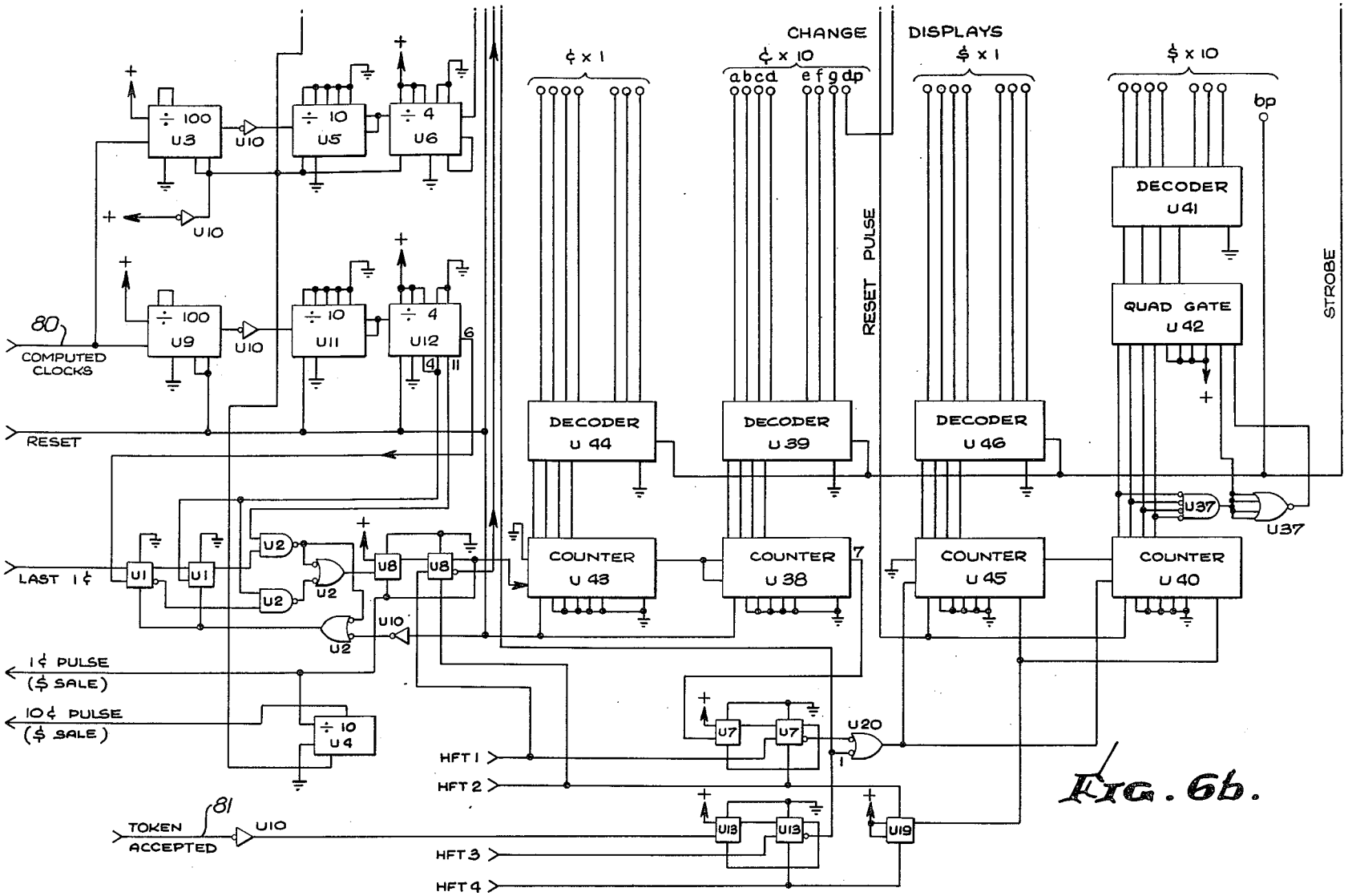
Figure 7A:
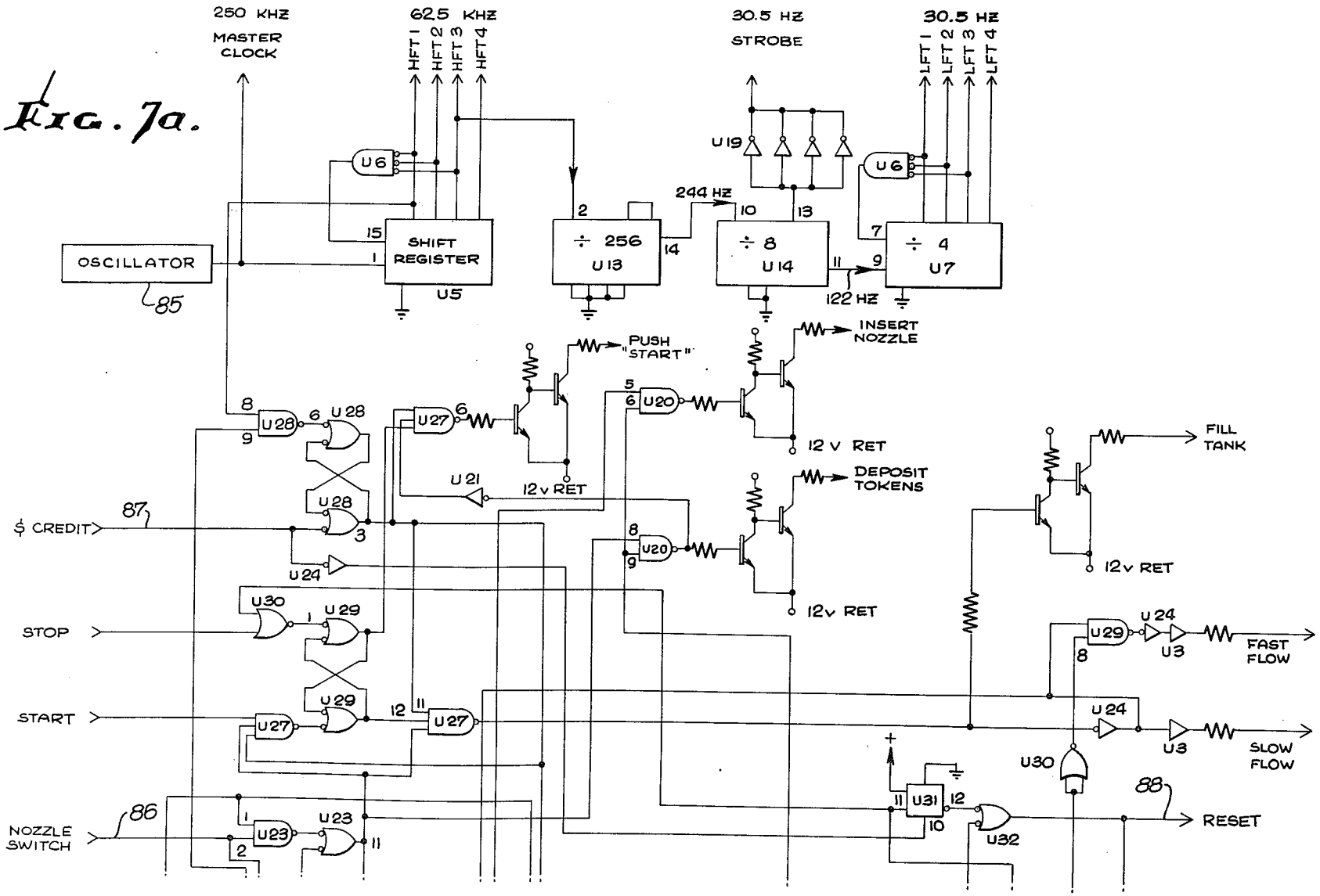
FIGS. 7*a* and 7*b* are a diagram of the oscillator, generator, control and resolution of FIG. 2.
Figure 7B:
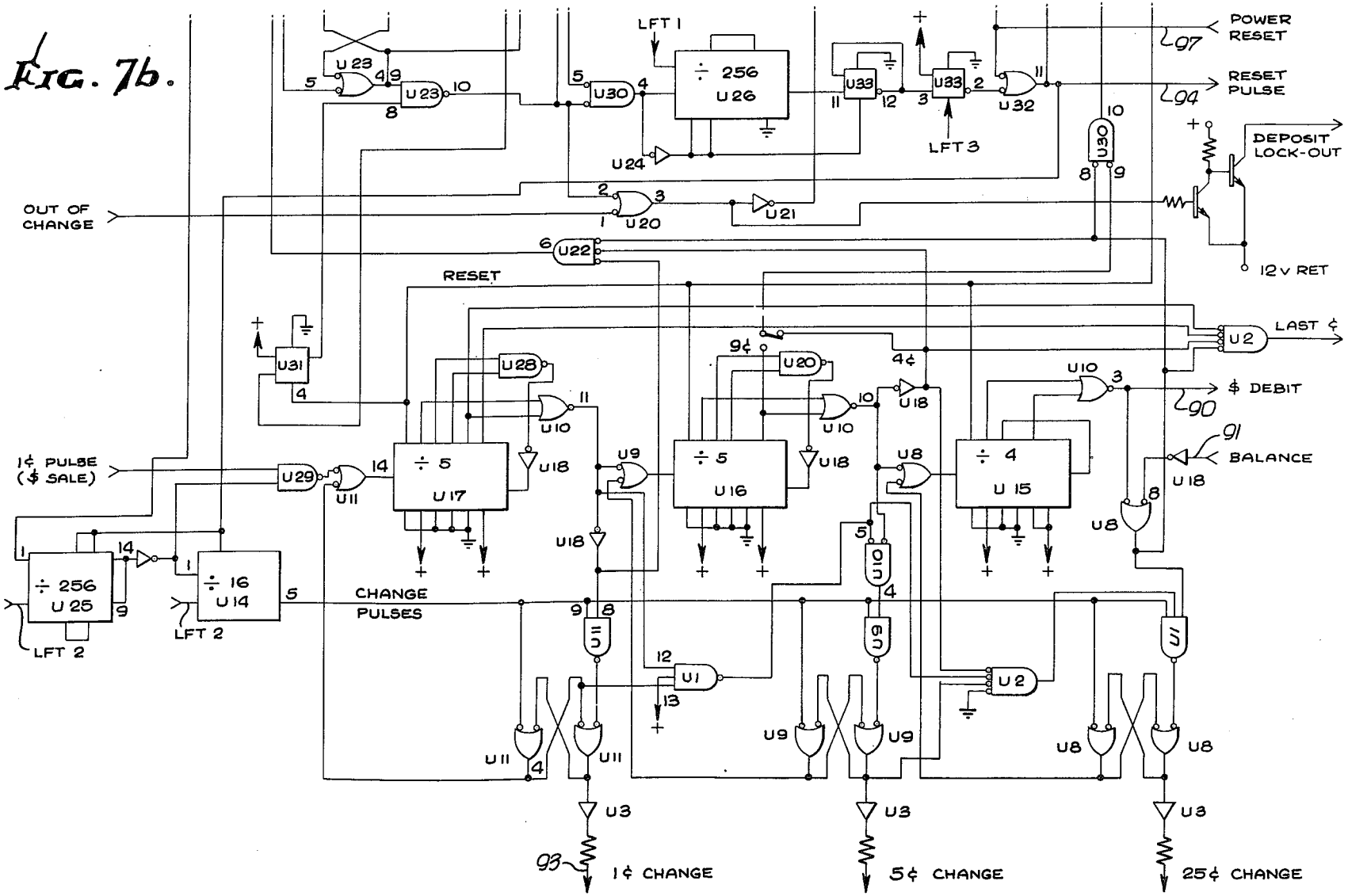

The overall electrical system is illustrated in FIG. 2, with the price and gallonage logic system shown in greater detail in FIGS. 3*a* and 3*b*, the credit, sale and change logic system shown in greater detail in FIGS. 6*a* and 6*b*, and the control and resolution system with oscillator and generator shown in greater detail in FIGS. 7*a* and 7*b*. The price per gallon for gasoline may be set by manually adjustable switches 50, and this price is displayed at the price display 51. Various types of indicators and displays are available and the preferred displays for the present embodiment are liquid crystal displays with 7 segment numerals. The segment identification for a 7 segment numeral is set out in FIG. 4, with the segments identified by the letters a through g and with the decimal point indicated by dp. The system disclosed herein is a decimal system using cents and dollars, and change is made in pennies, nickels and quarters. However it will be readily understood that the system of the invention is equally applicable to other monetary systems and to other coin values.

The displays are at a face of the upper compartment 11, with the price per gallon being displayed in tenths of a cent. The amount of fuel dispensed during a transaction is displayed in hundredths of a gallon at the gallonage display 52. The amount of dollar tokens deposited is displayed in dollars at the deposit display 53. The sale price of the gasoline being dispensed is displayed in dollars and cents at the sale display 54, and the amount of change due to a customer is displayed in dollars and cents at the change display 55. The customer starts fuel flow by pushing start button 58 and may stop fuel flow by stop button 59. Change is paid out to the customer by a change mechanism 60 operating in response to control signals from the control and resolution system. The change mechanism may be a conventional unit, and provides an out of change signal on line 61 to the control and resolution system when the supply of any coin falls below a predetermined limit. Power for operating the valve solenoid and the pump motor are provided by control relays at 62, with the relays being controlled in turn by control signals from the control and resolution system. A bank of accumulators 63 may be used to receive and register signals representing monetary amounts deposited and monetary and volume amounts dispensed to provide various records for management and control of a service station utilizing the dispensing system. Interconnections between the various components of FIG. 2 are indicated by lines, and corresponding legends are found in FIGS. 3, 6 and 7.

Figure 5:
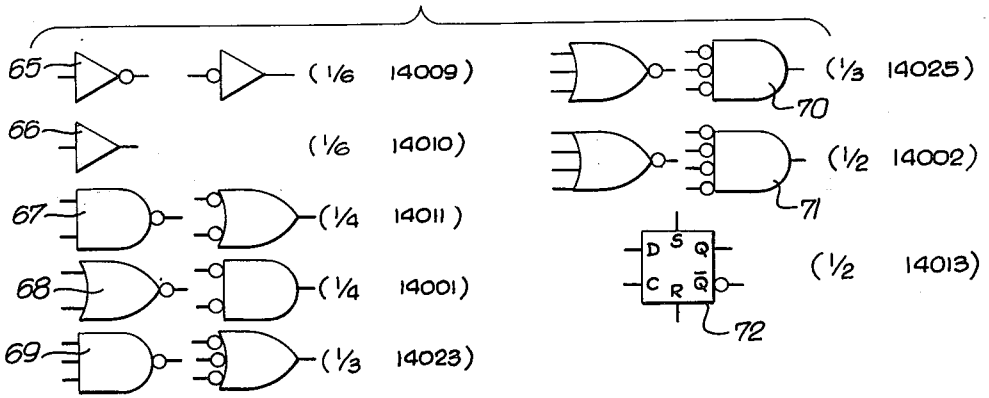
FIG. 5 illustrates and identifies certain of the logic symbols used in FIGS. 3, 6 and 7.

Standard logic symbols are used in FIGS. 3, 6 and 7, and are illustrated in FIG. 5. An example of a component for each item is set out in parenthesis adjacent the symbol. 65 is an inverter, 66 is a buffer amplifier, 67 and 69 are nand gates, 68, 70 and 71 are nor gates, and 72 is a flip flop.

PRICE AND GALLONAGE LOGIC FIGS. 3*a* and 3*b*.

The price and gallonage system contains the price computation and display and the gallonage delivered display. Binary coded decimal information from the price setting switches 50 is fed to the liquid crystal display decoder drivers U1, 2 and 3 (4055) and the presettable up/down counters U4, 5 and 6 (4029). The price computation system works as follows: A low signal from the flow meter system on line 75 causes flip flop U21, pin 1 to go high. U21, pin 12 will then go low when a 250 khz master clock signal on line 76 goes high, causing gate U22 to be opened at pin 1 in preparation for the next low going master clock, and releasing the preset enable imputs to U4, 5 and 6, which now contain a count equivalent to the price. Computed clocks are now generated on line 77 until U4, 5 and 6 count down to zero at which time the Carry Out terminal at U4, pin 7 will go low causing U21 flip flops to reset and block the input to gate U22. At this time, U22, pin 1 going high actuates the preset enable pins of U4, 5 and 6 causing the counters to be reloaded with the price in preparation for the next meter pulse. Therefore, assuming a price of 39.9 cents/gallon, for every meter pulse of one four-hundredth of a gallon, 399 computer clocks will be generated on line 77.

One four-hundredth of a gallon meter pulses are also fed from U21 to the divide by four counters U25 and 26. This results in one one-hundredth of a gallon pulses appearing at U26, pin 13 and U25, pin 2. U24 (½14518) further divides these pulses by 10 to produce one-tenth gallon pulses for accumulation purposes. U24 and 26 do not reset after each customer transaction so that an accurate accumulation of total dispenser gallonage delivered can be maintained. U25 resets after every transaction so that the gallonage display is an accurate representation of gallonage delivered to the customer.

LED1 and LED2 are light emitting diodes positioned adjacent the gallonage display 52 and used for dispenser calibration purposes. They provide a binary indication of zero, one, two and three 400th of a gallon. This results in a gallonage display accuracy of better than 1/400 of a gallon. The table below shows the four states of LED1 and LED2 and what they represent.

| LED1 | LED2 | GALLONAGE |
|---|---|---|
| Off | Off | 0 |
| On | Off | .0025 |
| Off | On | .005 |
| On | On | .0075 |

Binary coded decimal counters and decoders U15 through U18 (4033) count the number of 1/100th gallon pulses delivered and via display drivers U7 through U14 (14507) cause this information to be displayed on the liquid crystal gallonage display 52.

CREDIT, SALE AND CHANGE LOGIC FIGS. *6a* AND *6b*

This logic system contains displays showing dollars deposited, amount of sale, and change due.

Computed clocks from the price and gallonage logic of FIGS. *3a*, *3b* are received on line 80, each clock being representative of one four-thousandth of a penny. Counter U9 (14518) divides by 100, U11 (4018) divides by 10 and U12 (4018) divides by 4 resulting in 1 cent pulses at U12, pin 6; however, the first pulse at U12, pin 6 occurs after the first two thousand pulses and every 4000 thereafter. This results in clocking at the half cent point for a plus or minus half cent accuracy. The output at U12, pin 11 occurs at the 4000 count (full penny) and is used at the end of a full credit delivery sale to ensure that the full credit sale is delivered. This is accomplished by detecting the last penny of credit in the control and resolution system (FIGS. *7a* and *7b*) and using this information to activate the flip flops U1 and switch the information at U2 from the half cent to the 1 cent point. Therefore, on a full credit sale the customer receives his full credit gallonage, but on a sale resulting in the delivery of change the amount of change delivered is to the nearest penny, ± ½ cent.

Value counters U3, 5 and 6 (same as U9, 11 and 12) also divide by 4000 to produce 1 cent pulses for the accumulators. A 10 cent pulse is also produced via the divide by 10 counters U4 (½ 14518). The value counters do not reset after each transaction and therefore produce an accumulated true price × gallonage dollar value, whereas the $ sale pulse counter chains are reset after transaction and therefore produce an accumulated $ sale figure. The difference between the sale and value accumulations is therefore representative of the system inaccuracies due to giving change to the nearest penny.

Credit entry is by the use of tokens of one dollar value which are entered via the mechanical token acceptor 46 and if valid, sensed by photo-transistor 47 in conjunction with light source 35 coupled by fiber optic line 36. The accepted token breaks a light beam from light source to sensor. This signal is amplified and shaped by conventional circuits and an accepted token produces a pulse on line 81. A high frequency token pulse is produced by U13 in accordance with HFT3 and HFT4 timing. HFT1 through HFT4 are sequential four phase clocks produced in the timing and control system of FIGS. *7a* and *7b*, these clocks being continuously generated in sequence 1 through 4. Therefore, a token is only accepted during the HFT3 and HFT4 periods. U13 switching at this time causes U20, pin 1 to go low and clock U23 (½ 14518) at pin 10, a decimal counter used to store unit dollar credits. U17 (½ 14518) with input at pin 10 is a further decimal counter used to store credits in tens of dollars. Thus, credit capability of $99 is displayed via U24 (4055) and U18 (4055) which are liquid crystal display decoder drivers. U14 (4019) is a quad and/or select gate which is used to change the outputs of U17 credit information to U18 from all zeros to all ones to produce leading zero blanking of the display. This is accomplished by detecting all zeros at U14, pins 2, 3, 4 and 5 and switching U14 from the and to or state by the detected high at U15, pin 1 and low at U20, pin 4. This causes the output of U14 to switch from normal inputs at pins 6, 2, 15 and 4 to the VDD inputs at pins 1, 3, 5 and 7.

Dollar credits are also registered by the dollar digits of the change display. The change display during gasoline delivery counts down from the credit value and therefore since tokens must be accepted at any time during delivery, the dollar and tens of dollars display must be capable of counting up and down. This is accomplished by flip flop U19 which changes state at HFT2 and HFT4. At HFT2, U19 sets and places U45 (4029) and U40 (4029) in the up count state for token deposit. At HFT4, U19 resets and returns U45 and U40 to the down count condition. Thus credit information is always entered at a fixed time separate from debit information.

Computed penny pulses enter the change display down counters U43 (4029) and U38 (4029) at pins 15, and dollar debit information which appears at U38, pin 7 is timed between HFT1 and HFT2 by flip flops U7. Dollar debit information is also produced on line 82 from the timing and control system of FIGS. *7a* and *7b*. This information is counted by the lower numbered sections of U23 and U17. When the contents of these two counters are equal to that of their higher numbered counterparts, all outputs of exclusive-or gates U16 (14507) and U22 (14507) are low producing a low 'in balance' signal at line 83. This is used to inform the resolution unit that there are no more full dollar credits on the system.

Amount of sale information is displayed via counter/decoders U31, 25, 34, and 28 (4033) and their associated liquid crystal display drivers U32, 33, 26, 27, 35, 36, 29 and 30 (14507).

LAMP INDICATIONS FIG. *7a*

Four lamps are positioned on the front panel of the dispenser (FIG. 2). These indicate to the customer the state of the dispenser and what to do next. They are labeled as follows: (1) Insert Nozzle, (2) Deposit Tokens, (3) Push "Start", and (4) Fill Tank.

The criteria for illumination of these lamps are:

Insert nozzle: This lamp is lit when the dispenser is reset, the nozzle has not been removed from the dispenser and the change mechanism is not out of change.

Deposit tokens: This lamp will light as soon the nozzle is removed from the dispenser provided the dispenser has reset and is not out of change. This lamp will then remain illuminated until the customer has returned the nozzle to the dispenser.

Push "start": This light will come on only if the nozzle has been removed from the dispenser and at least one token deposited.

Fill tank: This light will be illuminated if the nozzle has been removed, at least one token deposited and the start button pressed. The light will then go out either when the nozzle is replaced or the customer has no credit remaining.

If during delivery the customer presses the Stop button, the Push Start light will be re-illuminated. From the time the customer replaces the nozzle to the completion of the reset cycle, the deposit lock-out solenoid in the token acceptor 46 is released to inhibit token acceptance. A token deposited at this time will automatically be returned to the customer. Deposit lock-out is also actuated if the dispenser is out of change.

TIMING AND CONTROL FIGS. 7*a* AND 7*b*

The timing and control system serves several functions, namely: generation of system timing pulses, generation of signals to dispense change, detection of customer actuated switches, generation of signals to cause gasoline flow, generation of 'state of dispenser' lamp indications and deposit lock-out signals, and to produce system reset.

TIMING GENERATION FIGS. 7*a* AND *b*

Figure 8:
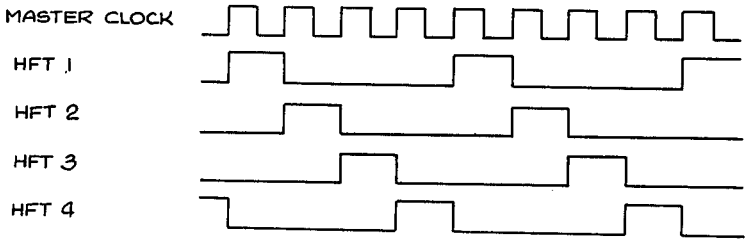
FIG. 8 is a timing diagram for the system.

An oscillator 85 produces a 250 khz master clock square wave (FIG. 8). Master clock pulses are fed to a 4 bit shift register U5 (½ 4015) which in conjunction with its associated gate U6 produces positive going four phase 62.5 khz clocks HFT1 through HFT4.

These clocks are used to control the dollar credit and debit timing. U13 (14520) then divides the 62.5 khz clocks by 16 × 16 to produce a frequency of 244 hz at U14 (½ 14520), pin 10. At U14, pin 13 the input at pin 10 is further divided by 8 to produce a 30.5 hz strobe which is used to produce the a.c. waveform necessary to drive the liquid crystal displays. Four gates, U19, are used in parallel to ensure that the strobe is capable of drawing the large currents used. The output at U14, pin 11 is half the frequency of the input of U14, pin 10 which results in a frequency of 122 hz at U7 (½ 4015), pin 9. LFT1 through LFT4 are produced by this section of U7 in the same manner as the HFT four phase pulses are produced.

CONTROL AND RESOLUTION LOGIC FIGS. 7*a* AND 7*b*

In the following explanation of the control and resolution logic it is assumed that change is in the tubes of the change mechanism 60, the customer follows the correct sequence to obtain gasoline, and the dispenser is in the reset state. At this time, the nozzle switch has not been operated and nozzle switch input on line 86 is low. U23, pin 4 and U20, pin 5 are high and U20, pin 3 and U20, pin 6 are also high causing the Insert Nozzle lamp to be illuminated. Actuating the nozzle switch by removing the nozzle from the dispenser causes U23, pins 2 and 5 to go high causing U23, pin 4 and U20, pin 5 to go low, and U23, pin 11 and U20, pin 8 to go high. This extinguishes the Insert Hose and illuminates the Deposit Token lights. Upon deposit of a token the $ Credit input on line 87 will pulse low causing U28, pin 3 to switch to the high state enabling gate U27 to go low at pin 6 and illuminate the Push Start lamp. At this time, the Reset signal at line 88 is removed by resetting U31 at pin 10 and gate U27 is enabled at pin 11 in preparation to commence flow when the Start button is pressed. Pressing the Start button actuates gate U27 at pin 12 and results in both the slow and fast flow valves being actuated. Flow will now commence as soon as the customer operates the nozzle.

RESOLUTION CIRCUIT FIGS. 7*a* AND 7*b*

The resolution unit basically consists of three counters, U17 (4018), a divide by five counter for pennies, U16 (4018), a divide by five counter for nickels, and U15 (4018), a divide by four counter for quarters. These counters were initially set to their zero state by the system reset. The first 1 cent Pulse received on line 89 causes all these counters to go to their maximum counts, 4, 4 and 3 respectively and produces a $ Debit pulse at line 90 which if only one dollar was deposited, will produce a balance signal at line 91 from the Credit, Sale and Change system of FIG. 6. Flow, if allowed by the customer, will now continue until the three counters return to their zero state which will be after the 100th 1 cent pulse. At this time, gate U22 will be enabled by all zero inputs from the counters, resulting in a high signal at U22 output. This will de-actuate the $ credit latch at U28, pin 9 in conjunction with an HFT1 clock at pin 8. The HFT1 timing is necessary to ensure that the deactivation of this latch is not coincident with activation caused by further token deposits.

Fast flow shut off occurs at a programmed point 4 cent or 9 cent prior to the end of full credits. The outputs of U16 are connected to program points, one of which is connected to the input of U30 at pin 9. Pin 8 of U9 will go low when the programmed point is reached. This causes U29, pin 8 to go low and stop fast flow.

Deactuation of the $ credit latch U28 at pin 6 causes U27, pin 11 to go low thus extinguishing the Fill Tank light and terminating slow flow. If another token is now deposited both slow flow and fast flow will be actuated.

If, at any point during flow, the customer presses the Stop button, latch U29 is deactivated by the low signal at U29, pin 1 causing a low at U27, pin 12 and resulting in both slow and fast flow being terminated, and the Push Start lamp to be reilluminated. Pressing the Start button again will recommence flow by reactivation of the U29 latch.

CHANGE CYCLE FIGS. 7*a* AND 7*b*

If the customer returns the nozzle to the dispenser with credits remaining on the system, a change cycle is initiated. Nozzle latch U23 will be deactivated upon return of the nozzle and U23, pin 9 will go high. U23, pin 10 will go low and lock latch U23 at pin 1 such that removal of the nozzle from the dispenser will not reactivate the latch. U25 (14520), a divide by 256 counter, will be enabled by the low at pin 1 and will count up until pin 14 goes high which will occur at a count of 128 LFT2 pulses, which is approximately 4.2 seconds after replacing the nozzle. At this time U25 will cease to count and remain locked with pin 9 being inhibited by the high at pin 14. U14 (½ 14520) is now enabled at pin 1 and change pulses at a rate of 2 per second are generated at output pin 5. Change will now be delivered to the customer in sequence, pennies, nickels, and quarters according to the credit remaining in the system.

If penny credits are remaining in U17, U10, pin 11 will be low enabling U11 at pin 8 which when a high change pulse at pin 9 occurs will cause the penny change latch U11 to operate and send a penny change pulse signal to the change mechanism via line 93. U11, pin 4 will go low and subtract a penny from U17 at input pin 14. Penny change pulses will continue until U10, pin 11 goes high at which time U11 will be inhibited at pin 8 and U1 enabled at pin 12. Upon completion of the final penny change pulse U11, pin 4 will go high enabling U1 at pin 13 which will cause U10, pin 5 to go low and pin 4 to go high if nickel credits remain on the system. Nickel change pulses will then be generated until U10, pin 10 goes high and upon completion of nickel change, gate U2 will be enabled, enabling the quarter change pulse logic. Quarter change pulses will then be generated until U10, pin 3 goes high and there is a dollar balance signal at line 91 to inhibit U8 at pin 8.

RESET CYCLE FIGS. 7*a* AND 7*b*

Upon completion of change delivery, U22 will be enabled at three inputs causing U22, pin 6 to go high resulting in the deactivation of the dollar credit latch U28. Deactivation of this latch causes U30, pin 5 to go low and U30, pin 4 to go high, removing the reset and enabling the clock enable inputs to U26 (14520) which is a divide by 256 counter. Following 128 LFT1 pulses (approximately 4 seconds), U33, pin 11 will go high clocking flip flop U33 and causing U33, pin 12 to go low. Four seconds later, U33, pin 12 will return to the high state and clock U33 at pin 3 causing U33, pin 2 to go low and via U32 generating a high at Reset Pulse line 94. This reset pulse at 94 will remain high until U33 is reset by LFT3 at which time U33, pin 2 will return to the high state and terminate the reset pulse. The duration of the reset pulse is approximately 0.065 second and is used to reset the credit and change counting system. U32, pin 11 going high also U31 at pin 11 resulting in pin 12 going low and producing a Reset signal at line 88 which resets all other counting logic in the system. Token deposit which was inhibited during the change and reset cycles is now reenabled at U20, pin 2 by unlocking the nozzle latch at U23, pin 8 from the resetting of flip flop U31 at pin 4. The dispenser is now ready for use by another customer. A Power Reset pulse is provided at line 97 for initially resetting the system when system power is turned on.

I claim:

1. In a calculator for a fluid dispensing system providing an output display in hundredths of a unit for customer indication and an additional output display in quarters of a hundredth of a unit for system calibration, the combination of a volume pulse generator producing volume pulses at a rate of four hundred pulses per unit of volume of fluid dispensed;

a volume accumulator including means for counting input pulses and displaying the count state for indicating the volume of fluid dispensed in decimal digits in hundredths of a unit for normal dispensing operation;

first and second divide-by-two circuits connected in series between said volume pulse generator and said volume accumulator and having a first output for two hundredths of a unit and a second output for one hundredths of a unit, with said second output connected to said volume accumulator as an input;

a first on-off indicator having said first output connected thereto; and a second on-off indicator having said second output connected thereto, with said first and second indicators indicating the volume of fluid dispensed in quarters of a hundredth of a unit for calibration of the dispensing system.

2. In a calculator for a fluid dispensing system providing an output display for customer indication in a predetermined portion of a unit of volume and an additional output display for system calibration in quarters of the predetermined portion, the combination of:

a volume pulse generator producing volume pulses at a rate of N pulses per unit of volume of fluid dispensed;

a volume accumulator including means for counting input pulses and displaying the count state for indicating the volume of fluid dispensed in digits in 1/M units for normal dispensing operation;

a divide-by-N/M circuit connected in series between said volume pulse generator and said volume accumulator and having a first output for 2/M units and a second output for 1/M units, with said second output connected to said volume accumulator as an input;

a first on-off indicator having said first output connected thereto; and a second on-off indicator having said second output connected thereto, with said first and second indicators indicating the volume of fluid dispensed in 0.25/M units for calibration of the dispensing system.

3. In a fluid dispensing system having a fluid flow meter, the combination of:

means for generating a flow signal varying as a function of fluid dispensed through the flow meter;

price means for generating a unit price signal for the fluid;

computer means having said flow signal and said unit price signal as inputs and providing as an output, monetary pulses as a function of fluid dispensed;

means for connecting flow and unit price signals to said computer means;

a sale accumulator including means for counting monetary pulses and displaying the count state for indicating the monetary amount of a sale of fluid;

means for connecting monetary pulses to said sale accumulator;

means for generating deposit pulses;

a deposit accumulator including means for counting deposit pulses and displaying the count state for indicating the monetary amount deposited by a customer;

means for connecting deposit pulses to said deposit accumulator;

a change accumulator including means for counting deposit pulses in an upward mode and for counting monetary pulses in a downward mode and for displaying the count state for indicating the monetary amount due to a customer at all times during a transaction; and means for connecting monetary and deposit pulses to said change accumulator.

4. In a fluid dispensing system having a fluid flow meter, means for generating a flow signal varying as a function of fluid dispensed through the flow meter, price means for generating a unit price signal for the fluid, computer means having said flow signal and said unit price signal as inputs and providing as an output, first monetary pulses as a function of fluid dispensed, and means for connecting flow and unit price signals to said computer means, the improvement comprising in combination:

a first logic circuit having said first monetary pulses as an input and providing first and second signals for every price increment of fluid dispensed through the flow meter, with said first signal generated at the half increment and said second signal generated at the full increment;

means for connecting first monetary pulses to said first logic circuit;

means for generating a third signal when a customer has one price increment of credit remaining;

a second logic circuit having said first, second and third signals as inputs and providing a second monetary pulse as an output for each first signal, except when said third signal is present, and then providing a second monetary pulse for said second signal;

means for connecting first, second and third signals to said second logic circuit;

means for generating deposit pulses;

a change accumulator including means for counting deposit pulses and for counting second monetary pulses for indicating the monetary amount due to a customer during a transaction; and means for connecting second monetary pulses to said change accumulator.

* * * * *

UNITED STATES PATENT AND TRADEMARK OFFICE

CERTIFICATE OF CORRECTION

PATENT NO. : 3,935,435

DATED : January 27, 1976

INVENTOR(S) : Robert C. Greenwood

It is certified that error appears in the above-identified patent and that said Letters Patent are hereby corrected as shown below:

Column 7, line 30, "Figs. 7a and b" should be --Figs. 7a and 8--

Column 9, line 40, after "also" insert --clocks--

Signed and Sealed this

Twentieth Day of July 1976

[SEAL]

*Attest:*

RUTH C. MASON
*Attesting Officer*

C. MARSHALL DANN
*Commissioner of Patents and Trademarks*